United States Patent [19]

Dixon et al.

[11] 4,302,865

[45] Dec. 1, 1981

[54] MULTI-DIRECTIONAL CANTED WHEEL CARRIER WITH SHIFTABLE CONTROL ARM FOR OPERABLE WALLS

[75] Inventors: Guy E. Dixon; William M. Mack, Jr., both of Miami, Fla.

[73] Assignee: Panelfold, Inc., Miami, Fla.

[21] Appl. No.: 108,468

[22] Filed: Dec. 31, 1979

[51] Int. Cl.[3] ..... A47N 15/00; E05D 13/02

[52] U.S. Cl. ..... 16/97; 16/95 R; 16/104; 16/106; 16/107; 16/89

[58] Field of Search ..... 16/97, 95 R, 104, 107, 16/105, 106, 18 A, 89, 94, 87.4, 87 B; 49/409, 410, 411, 425, 426, 427, 435; 160/19, 123

[56] References Cited

U.S. PATENT DOCUMENTS 3,813,728 6/1974 Johnson ..... 16/105

4,141,106 2/1979 Dixon ..... 16/95 R

*Primary Examiner*—Doris L. Troutman

*Attorney, Agent, or Firm*—Clarence A. O'Brien; Harvey B. Jacobson

[57] ABSTRACT

A multi-directional canted wheel carrier with shiftable control arm for supporting operable wall panels from upper and/or lower supporting tracks, with the control arm engaging a track slot or guideway and supported from the carrier for shifting when necessary between a leading and a trailing relationship to the panel supporting bolt to facilitate multi-directional movement of the carrier through track intersections. The carrier includes a single canted wheel or multiple canted wheels, and the bearings and tilt body structure of the canted wheel assembly provide efficient multi-directional movement of the carrier with minimum force requirements.

12 Claims, 15 Drawing Figures

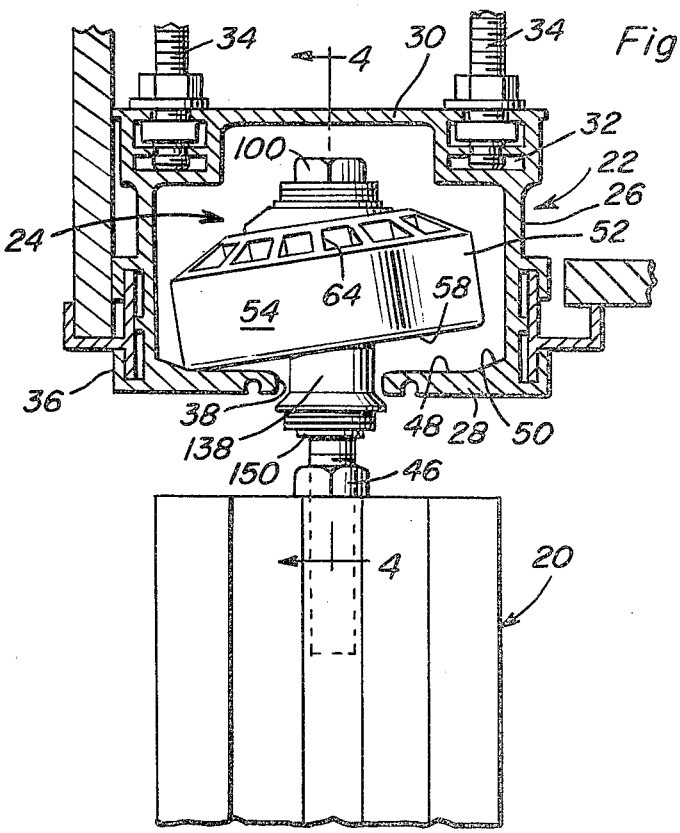
Fig. 3
Fig. 5
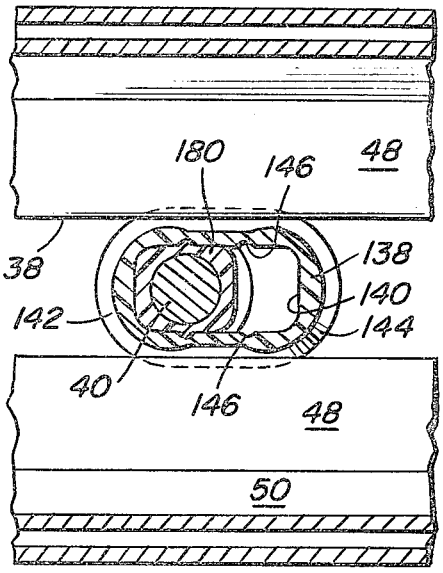
Fig. 4
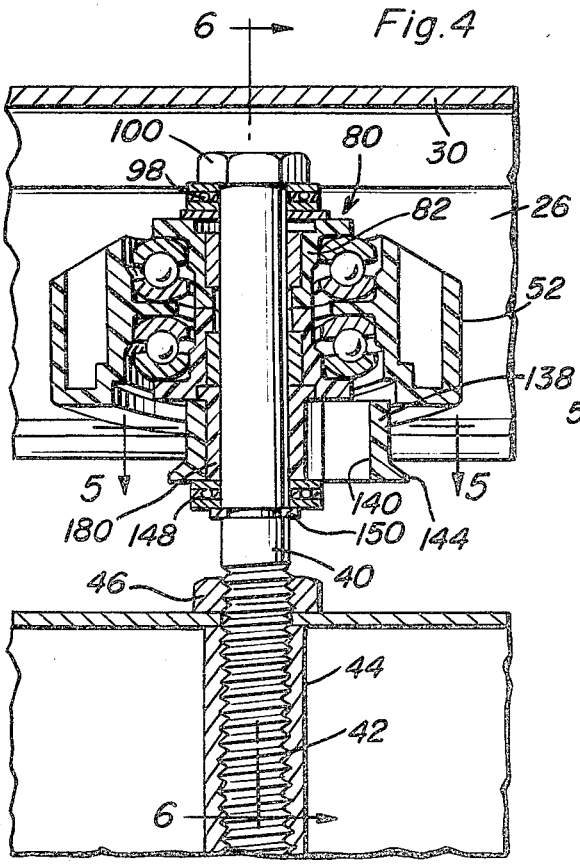
Fig. 6
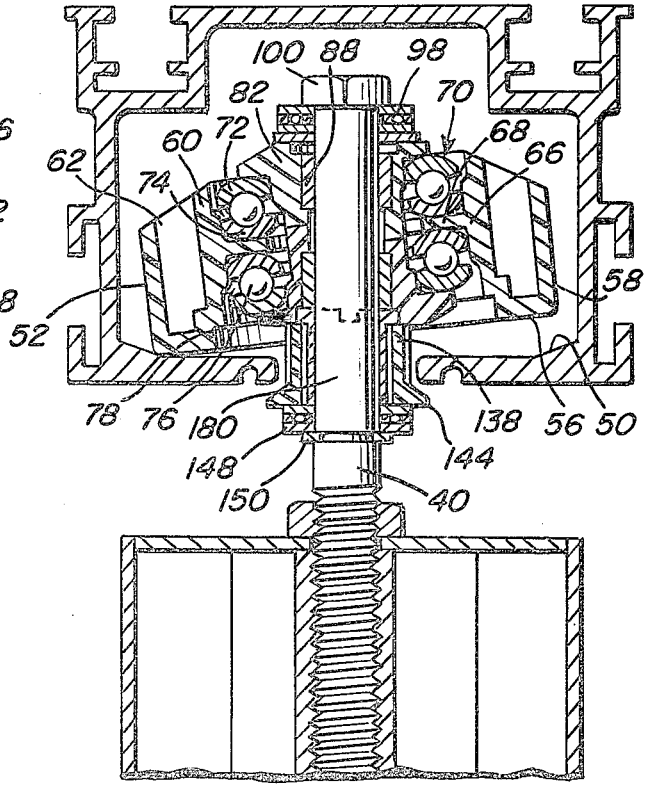

MULTI-DIRECTIONAL CANTED WHEEL CARRIER WITH SHIFTABLE CONTROL ARM FOR OPERABLE WALLS

BACKGROUND OF THE INVENTION

1. Field of the Invention

This invention relates to canted wheel carriers for movably supporting wall panels or the like from a track or similar supporting structure having generally horizontal flange surfaces engaged by a canted wheel or wheels with a control arm shiftably mounted on the carrier and received in a track slot or guideway for controlling the movement of the carrier with the shiftable characteristics of the control arm enabling the carrier to move along tracks having intersecting arrangements of various characteristics.

2. Description of Related Art

U.S. Pat. No. 4,141,106, issued Feb. 27, 1979, discloses canted wheel carriers of either the single wheel or multiple wheel type engaging supporting surfaces such as trackways with various arrangements being provided for enabling the carriers to move along intersecting trackways including a control arm engaged with the track slot. In addition to the above-mentioned patent, the prior art cited in that patent in the specification and by the Patent Office during prosecution are incorporated herein by reference thereto.

SUMMARY OF THE INVENTION

An object of the present invention is to provide a multi-directional canted wheel carrier with shiftable control arm for supporting wall panels or the like from a trackway in which the rotational axis of a single canted wheel or the rotational axes of multiple canted wheels are inclined from vertical and horizontal with a portion of the peripheral axial surface of the canted wheel or wheels rollingly engaging a generally horizontal flange surface on the trackway with the carrier including a shiftable control arm engaged with a track slot or guideway to facilitate multi-directional movement of the carrier through intersecting or angulated track slots with a minimum of force.

Another object of the invention is to provide a canted wheel carrier in accordance with the preceding object in which the control arm is elongated in the direction of movement of the carrier and longitudinally slidably mounted between a leading and a trailing relationship to the vertical support shaft or bolt of the wheeled carrier so that the control arm will, when necessary, be moved automatically from a leading relationship to a trailing relationship when the carrier moves through an angled track intersection.

A further object of the invention is to provide a canted wheel carrier in accordance with the preceding object in which the longitudinally slidable control arm is slidable between two longitudinal positions relative to a supporting bolt extending through the track slot.

These together with other objects and advantages which will become subsequently apparent reside in the details of construction and operation as more fully hereinafter described and claimed, reference being made to the accompanying drawings forming a part hereof, wherein like numerals refer to like parts throughout.

BRIEF DESCRIPTION OF THE DRAWINGS

FIG. 3 is a transverse, sectional view of a top track illustrating, in elevation, a top single canted wheel carrier.

FIG. 4 is a longitudinal, sectional view taken substantially upon a plane passing along section line 4–4 of FIG. 3 illustrating structural details of the single canted wheel carrier and shiftable control arm.

FIG. 5 is a plan sectional view taken substantially upon a plane passing along section line 5—5 of FIG. 4 illustrating the structure of the shiftable control arm and its relationship to the supporting bolt.

FIG. 6 is a transverse, sectional view taken substantially upon a plane passing along section line 6—6 of FIG. 4 illustrating further structural details of the canted wheel carrier including the orientation of the tilt body components and the bearing structures.

DESCRIPTION OF THE PREFERRED EMBODIMENT

Figure 1:
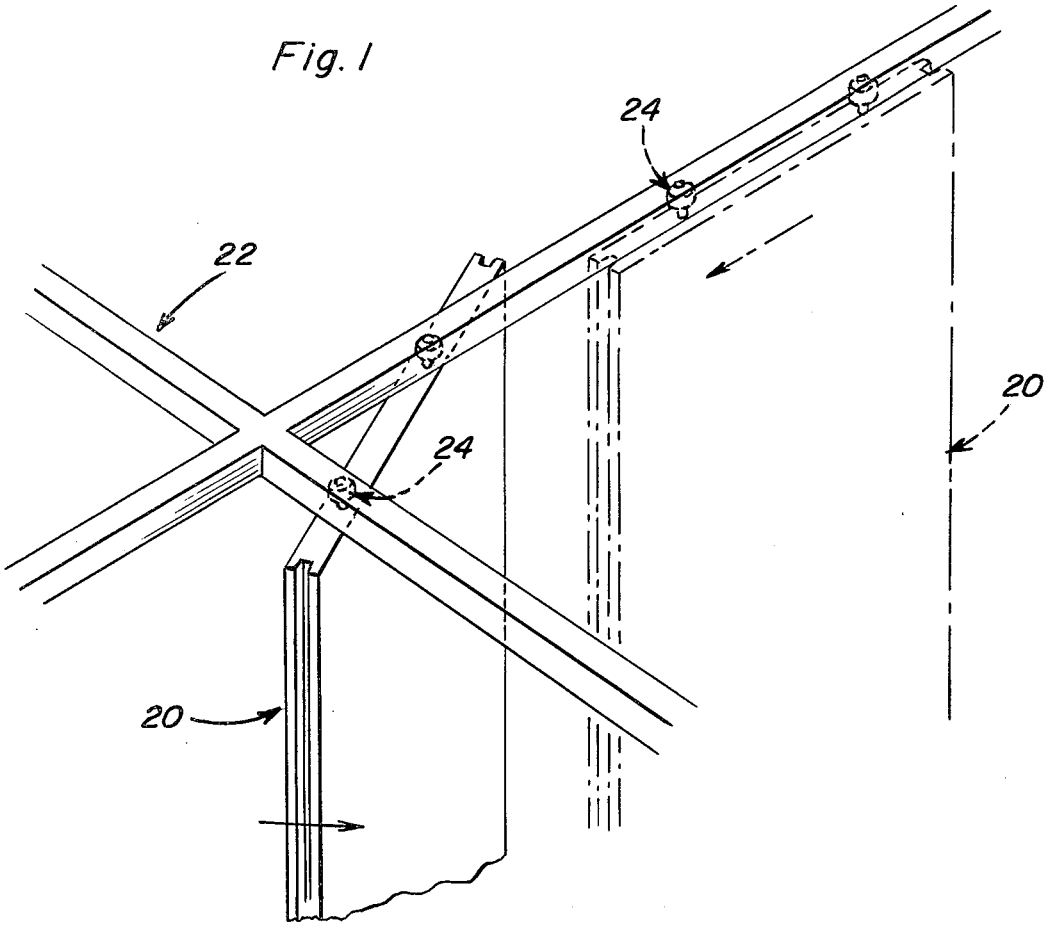
FIG. 1 is a schematic perspective view illustrating intersecting tracks in an overhead track system with a wall panel suspended therefrom and illustrating that the wall panel can negotiate an intersection by using the canted wheel carrier of the present invention.
Figure 2:
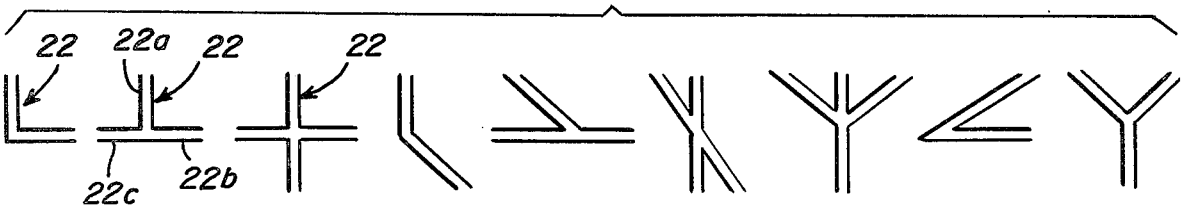
FIG. 2 is a group of diagrammatic views showing alternative 2, 3 and 4-way track intersections and angulation arrangements with which the canted wheel carrier of the present invention can be used.
Figure 12A:
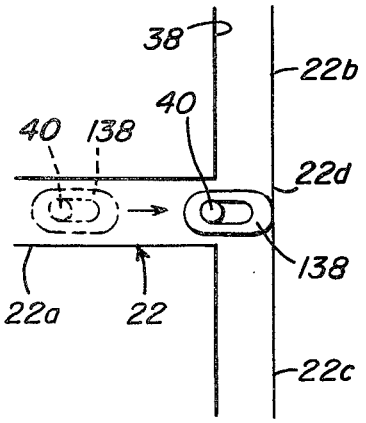
FIGS. 12*a*, 12*b* and 12*c* are schematic plan views illustrating operation of the shiftable control arm in relation to the supporting bolt when the canted wheel carrier passes through a 3-way intersection and makes a right angle turn.
Figure 12B:
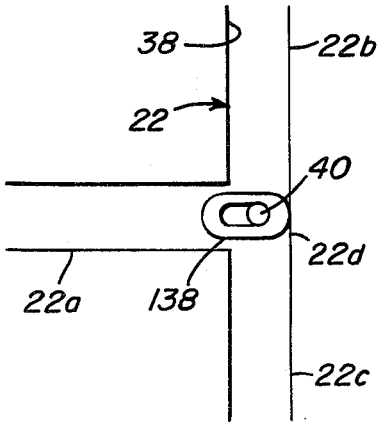
Figure 12C:
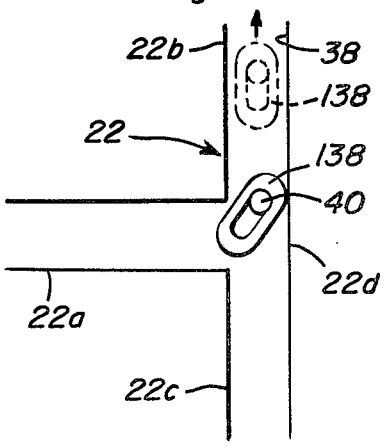

Referring now specifically to FIG. 1, a wall panel 20 is supported from an overhead track 22 having a 4-way intersection. The wall panel 20 may be a component of an operable wall, wall module, or the like, in which it is desired to move the panel 20 to various positions in a room by moving carriers 24 which support the panel 20 along the track 22 to any position, such as the broken line position in FIG. 1. The track 22 can be a portion of a grid track system having various arrangements of track components, such as 2-way, 3-way and 4-way intersections, examples of which are shown in FIG. 2.

FIGS. 3–6 disclose a single canted wheel carrier 24 received in the track 22 which is generally an inverted channel-shaped member having vertical side walls 26 with inturned bottom flanges 28 and an interconnecting top web 30 with longitudinally extending channel-shaped grooves 32 in the outer edge portions thereof for receiving supporting bolts 34 to mount the track 22 in supported relationship to an overhead support. The exterior of each wall 26 is provided with a channel-shaped recess extending longitudinally thereof as designated by numeral 36 to support a transition strip engaging fascia or ceiling material. The inner edges of the flanges 28 are spaced apart and rounded slightly to define a track slot 38 through which a supporting bolt 40 extends with the lower end of the bolt 40 being screw threaded at 42 for adjustable reception in a sleeve 44 and a retaining and adjusting nut 46. The aforementioned structure is generally similar to that disclosed in U.S. Pat. No. 4,141,106. The upper surface of the flange 28, designated by numeral 48, is generally horizontal from the slot 38 outwardly with the outermost edge of the upper surface being inclined as at 50 where it joins with the inner surface of the side wall 26 with this angle generally being approximately 20–30°. The track 22 is constructed of metal, such as extruded aluminum, or the like, with the track slot 38 having a substantially constant width throughout its length.

A single canted wheel 52 is disposed in the track 22 and includes a cylindrical external peripheral surface 54 and a generally flat lower axial surface 56 merging therewith the corner juncture being slightly chamfered as at 58 with the chamfered corner 58 engaging the juncture between the generally horizontal portion 48 and the inclined portion 50 of the track flange as illustrated in FIG. 6. The upper end of the wheel 52 is beveled or inclined as at 60 and a portion of the wheel is hollow as at 62 with the hollow area being peripherally segmental and defined by a plurality of radial walls 64 which join the outer peripheral wall and an inner wall 66 of the wheel which is also substantially cylindrical and provided with an inwardly extending centrally located flange 68, as illustrated in FIGS. 4 and 6. The flange 68 separates the interior of the wheel 52 into upper and lower compartments each of which receives a ball bearing assembly 70 with each ball bearing assembly 70 including a pair of opposed generally U-shaped bearing races 72 and 74 which define a continuous cavity for a plurality of ball bearings 76. The inner bearing races engage the surfaces of the flange 68 and the outer races have their outer edges received in a slightly outwardly offset portion 78 of the wall 66, as illustrated in FIGS. 4 and 6.

Figure 9A:
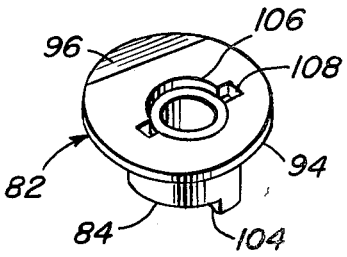
FIGS. 9*a* and 9*a* are top and bottom perspective views of one of the tilt body components.
Figure 9B:
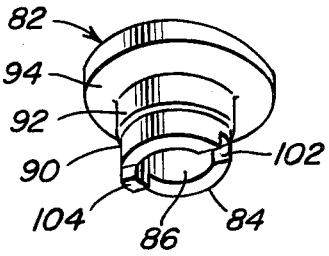

Disposed between the vertical bolt 40 and the wheel 52 is a tilt body assembly 80 which includes identical upper and lower tilt bodies 82 with the lower body 82 being inverted in relation to the upper body 82. The tilt body 82 includes a generally cylindrical member 84 having a cylindrical bore 86 receiving the bolt 40 with a bushing 88 being optionally provided between the bore 86 and bolt 40. The member 84 includes cylindrical portions 90 and 92 of slightly different diameters, as shown in FIGS. 9*a* and 9*b* with portion 90 aligned with the inner races 74 and portion 92 aligned with the outer races 72 of the bearing assembly. One end of the body 82 is provided with a laterally extending flange 94 which overlies and engages the outer surfaces of the outer races 72 as illustrated in FIGS. 4 and 6, so that the opposed flanges 94 on the tilt body assembly 82 will retain the bearing assemblies 70 in assembled relationship to the wheel 52 and the supporting bolt 40. As illustrated, the bore 86 is eccentrically arranged in relation to the tilt bodies 82 which eccentricity is clearly illustrated when comparing FIGS. 4 and 6 so that the rotational axis of the wheel 52 is inclined in relation to the bolt 40. The upper surface of the flange 94 is beveled or inclined on the larger portion thereof as indicated by numeral 96 in FIG. 9*a*, with the flat portion of flange 94 being engaged by a thrust bearing and washer assembly 98 with a head 100 on the bolt 40 supporting the weight of the panel 20 from the track. The other end of the body 82 has a radial notch 102 therein and a diametrically opposed lug 104 thereon which interfit with each other when two oppositely oriented tilt bodies 82 are assembled so that they are non-rotatably connected together. The flanged end of each tilt body 82 is provided with a counterbore 106 and a pair of radially extending notches 108 which are covered by the thrust bearing and washer assembly 98 on the upper tilt body 82. The lower tilt body 82 is engaged by a control arm 110 which in the single wheel carrier includes hollow body 138 shown in FIG. 10 and a spacer sleeve 180 shown in FIG. 11. The sleeve is generally a rectangular body having a bore 181 receiving the bolt 40 therethrough and ribs 182 on the outer surface thereof parallel to the bolt. The upper end of the sleeve 180 includes an axial projection 183 of cylindrical configuration and diametrically opposed radial projections 184 which are engaged in notches 108 in lower tilt body 82.

The body 138 includes a hollow generally rectangular interior 140 which receives the sleeve 180, as illustrated in FIGS. 4 and 6. The external ends 142 of the body 138 are each rounded into generally semi-cylindrical configuration with the side walls being slightly recessed as illustrated in FIG. 5 with the lower peripheral edge of the body 138 being outwardly flared as indicated by numeral 144. The parallel opposed interior surfaces of the hollow interior 140 of the body 138 are optionally provided with a pair of longitudinally spaced notches or grooves 146 which are spaced apart sufficient to enable longitudinal sliding movement of the body 138 in relation to the sleeve 180 with the ribs 182 on the sleeve 180 being received in the grooves 146, as illustrated in FIG. 5, with the body 138 being capable of movement between extreme longitudinal positions transversely of the sleeve 180 and the bolt 40 which extends therethrough so that, in effect, the body 138 can shift between a leading a trailing relationship to the bolt 40. Also, as illustrated, the width of the control arm 110 is slightly less than the width of the track slot 38 and the rounded ends 142 of the body 138 facilitates longitudinal movement of the control arm 110 in the track slot and also facilitates movement through intersecting or angulated track slots.

To retain the control arm 110 in assembled relationship and all of the other components on the bolt, a lower thrust bearing and washer assembly 148 is provided on the bolt which is retained in position by a snap ring or split ring 150 received in an appropriate groove in the bolt 40. Other suitable means may be provided for retaining the thrust bearing assembly and the other components assembled which can be removed to enable disassembly, repair, and the like. Also, the specific details of the thrust bearing assemblies at the upper and lower ends of the canted wheel carrier may be conventional and washers or shims may be provided to vary the effective supporting height of the wheel carrier, if necessary or desired.

Figure 7:
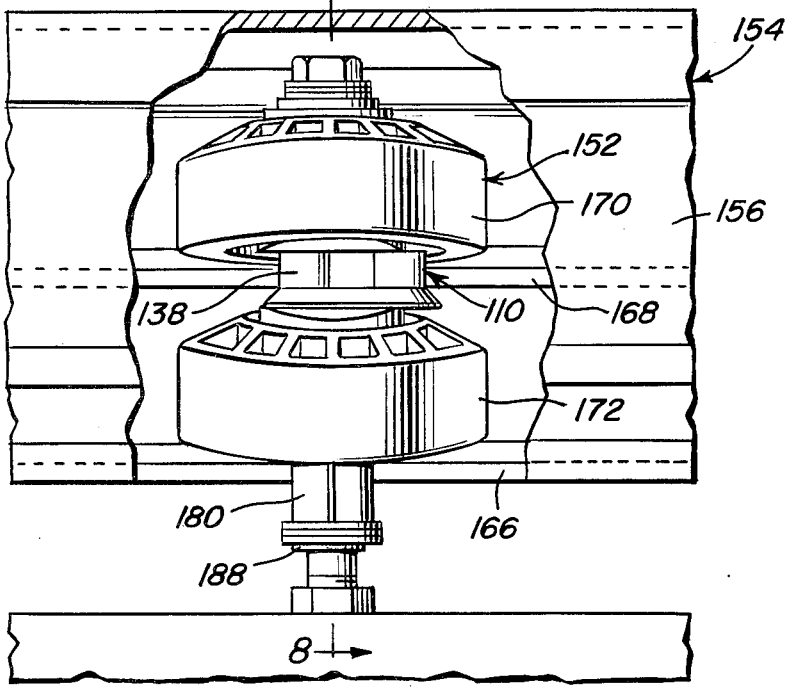
FIG. 7 is a longitudinal, sectional view of a top track having two trackways receiving a top multiple canted wheel carrier.
Figure 8:
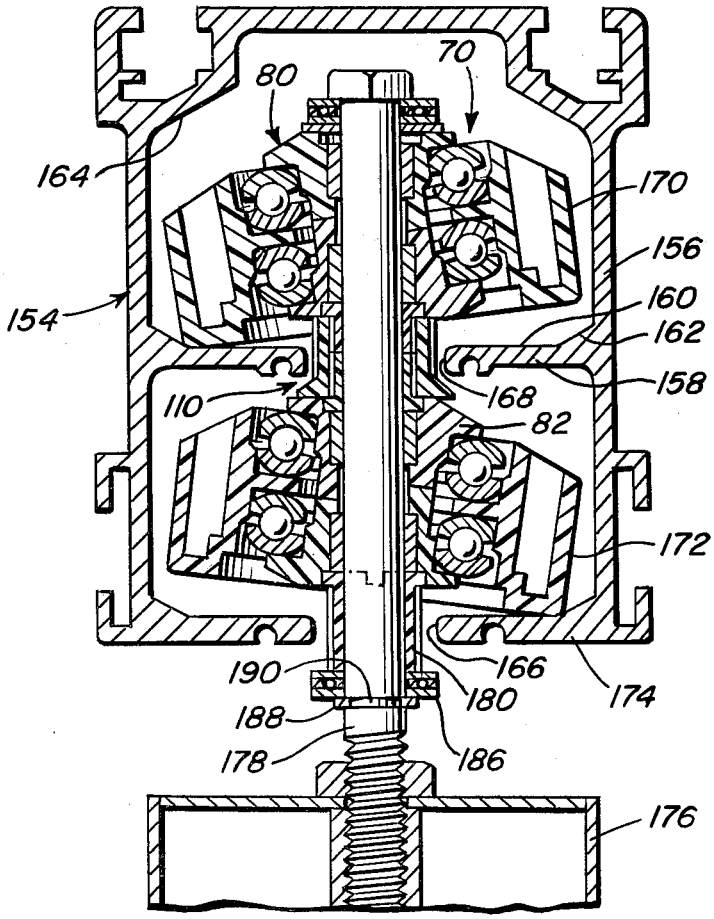
FIG. 8 is a transverse, sectional view taken substantially upon a plane passing along section line 8—8 of FIG. 7 illustrating the structural details of the multiple canted wheel carrier with shiftable control arm in the upper track slot.

FIGS. 7 and 8 disclose a multiple canted wheel carrier designated by the numeral 152 received in a multiple track 154 similar to the track 22, except that the side walls 156 are vertically longer that the side walls 26 and an intermediate generally horizontal flange 158 is formed centrally of each of the side walls 156 with the upper surfaces thereof including a major generally horizontal flat portion 160 and an angulated outer portion 162. The upper corner portions of the trackway on the interior thereof may be inclined as at 164 to make optimum use of the internal area of the trackway. Thus, two vertically spaced aligned trackway slots 166 and 168 are provided and an upper canted wheel 170 is disposed above and in rolling engagement with the flange 158 to one side of the upper track slot 168 and a lower wheel 172 is canted in the opposite direction and is in rolling engagement with the lower flange 174 on the trackway in opposite relation to the lower track slot 166 as illustrated in FIG. 8. Thus, the two wheels 170 and 172 rotate in opposite directions about oppositely inclined axes and cooperate to support the weight of a panel 176 from a supporting bolt 178 which structure is the same as that shown in FIGS. 3–6, except for the bolt being longer so that it extends through both of the canted wheels 170 and 172.

Figure 10:
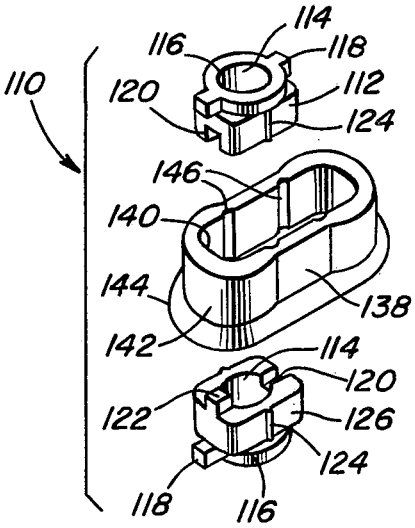
FIG. 10 is an exploded group perspective view illustrating the components of the shiftable control arm used in a multiple canted wheel carrier.
Figure 11:
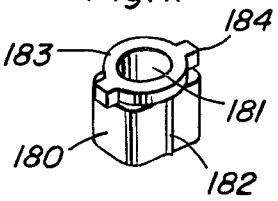
FIG. 11 is a perspective view of a spacer used on the bolt.

In this construction, the upper and lower wheels, the bearing assemblies and the tilt body components are all the same as the corresponding components in FIGS. 3–6 and the same reference numerals are applied thereto. Between the upper and lower wheels 170 and 172, the control arm 110 is oriented in the track slot 168. The embodiment of the control arm used with the multiple canted wheel carrier 152 includes hollow body 138 and upper and lower identical sleeves 112 and 126 as shown in FIG. 10. Each sleeve 112 and 126 is generally rectangular and provided with a bore 114 therethrough receiving the bolt 40. One end of each sleeve includes a cylindrical axial extension 116 with the oppositely disposed radially extending lugs 118 with the projection and lugs being received in the counterbore 106 and notches 108 in tilt bodies 82, respectively, as illustrated in FIG. 8 thereby locking the tilt body assemblies 80 to the control arm 110. The other end of each sleeve 112 and 126 is provided with a notch 120 in alignment with one of the lugs 118 and a lug 122 diametrically opposed thereto and the opposite side walls of the sleeve are each optionally provided with a vertically extending rib 124. When the sleeves 112 and 126 are assembled in body 138 as shown in FIGS. 8 and 10, they are inverted in relation to each other and the lug 122 on the upper sleeve 112 is received in the notch 120 in the lower sleeve 126 and the lug 122 on lower sleeve 126 is received in notch 120 in the upper sleeve 126, respectively, thus locking the upper and lower sleeves 112 and 126 together. Received in the lower track slot 166 is a spacer sleeve 180 shown in FIG. 11, mounted on bolt 178 with the pair of diametrically opposed lugs 184 being received in notches 108 in inverted tilt body 82. The lower end of the sleeve 180 rests upon a thrust bearing and washer assembly 186 supported on the bolt 178 by a snap ring or split ring 188 received in a groove 190, thus enabling assembly and disassembly of the components. Also, the control arm 110 may be located in either the upper track slot, as shown, or may be located in the lower track slot in which event the two sleeves 112 and 126 would be used in the upper track slot to maintain proper orientation of the tilt body assemblies. Another option would be to locate the control arm in a guideway in the top of track colinear with the track slot.

As illustrated, the tilt body assemblies 80 are all identical with the tilt body assembly associated with the wheel 170 being arranged in the same manner as in FIG. 6 but the tilt body assembly arranged with the wheel 172 being arranged in a diametrically opposite manner so that the wheels are tilted in opposite directions and the wheel 170 will rotate about an inclined axis which is inclined in the opposite direction from vertical and horizontal in relation to the inclined axis of rotation of the wheel 172. The actual angle of tilt of the tilt body assemblies may vary although the degree of angle from vertical is preferably approximately $8\frac{1}{2}°$. The wheels may be hollow or solid and are preferably constructed of plastic material as is the control arm in both embodiments. Any suitable bearing and anti-friction assembly may be used between the tilt body and the hanger bolt, such as bushings, needle bearings, or direct surface engagement depending upon the load being carried by the carriers, the lubrication characteristics, and the like.

FIGS. **12*a*, 12*b* and 12*c* illustrate schematically the movement of the control arm in relation to a 3-way intersection of track slot 38 in a track 22 with the track segments being designated by numerals 22*a*, 22*b* and 22*c*. As the control arm body 138 approaches the intersection, when in leading relation to the bolt 40, the leading end of the body 138 will engage the edge of track slot 22*d* which is the juncture between track segments 22*b* and 22*c*. The inertia forces exerted by the moving operable wall panel 20 or a direct manual force exerted thereon will cause the bolt 40 to shift longitudinally in relation to the control arm body 138 causing it to assume a trailing relationship to the bolt 40 as illustrated in FIB. 12*b* with the bolt centered in relation to the track segments. Thereafter, lateral force exerted on the operable wall panel will move the bolt 40 toward the track segment 22*b* or 22*c* with the control arm body 138 following the bolt 40 in trailing relation. In the event the body 138 is in trailing relation to the bolt 40, when the bolt 40 reaches a position in alignment with the center of the intersecting track segment, lateral force on the operable wall panel will cause the bolt 40** to move into the intersecting track segment and the control arm to trail behind it.

The inertia forces of the operable wall are such that once the force is sufficient to move the control arm body 138 so that the ribs 124 or 182 and grooves 146 which are interengaged become disengaged, the movement of the body member will continue until the ribs 124 or 182 engages the grooves 146 with a snap action at the opposite end of the body 138 or, if the ribs 124 or 182 and grooves 146 are omitted, to move the body 138 smoothly between its extreme ends. The manufacture of these components from plastic material provides a self-lubricating characteristic thereto and the plastic material provides adequate resiliency and elastic characteristics to enable repetitive movement of the slidable control arm body 138 for an extended period of time.

Because the control arm is non-rotatable in relation to the tilt body or tilt bodies, the control arm serves to maintain the tilt body or tilt bodies, and the inclined rotational axis or axes, in correct orientation to the direction of travel of the carrier as it negotiates the intersections. The control arm functions in a similar manner when negotiating 2-way, 3-way and 4-way intersections. The shiftability of the control arm facilitates movement through intersections with a minimum force required. The track may be disposed above or below the wall panel and the carrier connected with the top or bottom, respectively, of the panel. The guideway can be any longitudinally extending surface or surfaces which serves to guide the control arm. In addition, other types of shiftable motion of the control arm is possible such as a pivotal or rocker motion in a vertical plane.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A canted wheel carrier for movably supporting wall panels from a track, said carrier including a canted wheel having a rotational axis inclined in relation to vertical and horizontal whereby a portion of the peripheral axial surface of the canted wheel is rollingly engaged with a supporting surface of the track and the diametrically opposite portion of the wheel is spaced from the supporting surface, said track having spaced track flanges defining a longitudinally extending track slot, and wherein said carrier includes a tilt body having said wheel rotatably mounted thereon for rotation about the inclined axis, support means rotatably connecting said tilt body with said panel, and a longitudinally extending control arm connected to said tilt body such that the control arm and tilt body are non-rotatable in relation to each other, the control arm including a shiftable member operative in a longitudinally extending guideway in the track for maintaining said tilt body and said inclined rotational axis in correct orientation to the direction of travel of the carrier and facilitate negotiation of angle turns in the track.

2. The structure as defined in claim 1, wherein said shiftable member shifts the effective position of said control arm between a leading and a trailing relationship to said support means.

3. The structure as defined in claim 2, wherein said shiftable member is longitudinally shiftable relative to said support means.

4. The structure as defined in claim 3, wherein said longitudinally shiftable member is smoothly slidable between extreme longitudinal positions.

5. The structure as defined in claim 4, wherein said longitudinally shiftable member is a longitudinally elongated body having a longitudinally elongated slot in the middle thereof receiving said support means, and a sleeve on said support means smoothly slidable in said slot.

6. The structure as defined in claim 3, wherein said longitudinally shiftable member is snap-shiftable between extreme longitudinal positions.

7. The structure as defined in claim 6, wherein said longitudinally shiftable member is a longitudinally elongated body having a longitudinally elongated slot in the middle thereof receiving said support means, and a sleeve on said support means slidable in said slot wherein said sleeve and body include interengaging ribs and grooves for positioning the body at two extreme positions in relation to the support means.

8. The structure as defined in claim 7, wherein said body and/or said sleeve are constructed of plastic material to provide resiliency and elasticity to these components for enabling snap-shifting movement therebetween.

9. The structure as defined in claim 1, wherein said guideway is said track slot.

10. The structure as defined in claim 1, wherein said supporting surface is one of said track flanges.

11. The structure as defined in claim 1, wherein said track includes a second pair of spaced track flanges defining a second longitudinally extending track slot, and said carrier includes a second canted wheel spaced vertically from the first canted wheel and rotatably mounted on a second tilt body, said second wheel engaging a track flange, said first and second wheels being canted in opposite directions, and wherein said control arm is non-rotatably connected to the tilt bodies of both said first and second canted wheels.

12. The structure as defined in claim 11, wherein said guideway is either of said track slots.

* * * * *